US007150069B2

(12) United States Patent
Hori et al.

(10) Patent No.: US 7,150,069 B2
(45) Date of Patent: Dec. 19, 2006

(54) ELECTRIC VACUUM CLEANER

(75) Inventors: Masahiko Hori, Niigata-ken (JP); Mineyuki Inoue, Niigata-ken (JP); Toshiaki Ogawa, Niigata-ken (JP); Takeshi Yamada, Niigata-ken (JP)

(73) Assignee: Twinbird Corporation (JP)

( * ) Notice: Subject to any disclaimer, the term of this patent is extended or adjusted under 35 U.S.C. 154(b) by 610 days.

(21) Appl. No.: 10/724,939

(22) Filed: Dec. 1, 2003

(65) Prior Publication Data

US 2004/0250376 A1 Dec. 16, 2004

(30) Foreign Application Priority Data

Jun. 13, 2003 (JP) ..... 2003-170007

(51) Int. Cl.
*A47L 9/06* (2006.01)

(52) U.S. Cl. ..... 15/417; 15/393; 15/403

(58) Field of Classification Search ..... 15/393, 15/403, 415.1, 416, 417
See application file for complete search history.

(56) References Cited

U.S. PATENT DOCUMENTS

| | | | | |
|---|---|---|---|---|
| 1,992,986 | A * | 3/1935 | Bender | 15/339 |
| 4,980,945 | A | 1/1991 | Bewley | |
| 5,060,342 | A * | 10/1991 | Brazier | 15/322 |
| 6,101,668 | A | 8/2000 | Grey | |
| 6,799,350 | B1 | 10/2004 | Gordon | |
| 6,966,098 | B1 * | 11/2005 | Sako et al. | 15/364 |
| 2002/0050016 | A1 | 5/2002 | Willman et al. | |
| 2004/0045126 | A1 * | 3/2004 | Parker et al. | 15/403 |
| 2004/0134025 | A1 * | 7/2004 | Murphy et al. | 15/403 |
| 2004/0139572 | A1 * | 7/2004 | Kisela et al. | 15/320 |
| 2005/0076468 | A1 * | 4/2005 | Matousek et al. | 15/403 |
| 2005/0262661 | A1 * | 12/2005 | Baer et al. | 15/403 |

FOREIGN PATENT DOCUMENTS

| | | |
|---|---|---|
| DE | 11 50 497 B | 6/1963 |
| GB | 2 343 616 A | 5/2000 |
| JP | H06-046651 | 6/1994 |
| JP | 8-294468 | 11/1996 |
| JP | H08-294468 | 11/1996 |
| JP | 2000-060773 | 2/2000 |
| JP | 2000 060773 A | 2/2000 |
| JP | 3041713 | 3/2000 |
| JP | 2003235776 A * | 8/2003 |

* cited by examiner

*Primary Examiner*—Terrence R. Till
(74) *Attorney, Agent, or Firm*—Akerman Senterfitt

(57) ABSTRACT

An electric vacuum cleaner includes a nozzle assembly 5 including: a base member 6; a movable member 7 inversely rotatably attached to the base member 6 and having one surface formed with a suction opening 20; and a covering member 8 movably attached to the base member 6. Holding members 22 for holding a cleaning sheet 21 are formed on the other surface of the movable member 7. When the one surface of the movable member 7 faces a floor surface and the other surface thereof is covered by the covering member 8, the electric vacuum cleaner can pick up filth through the suction opening 20. When the movable member 7 is rotated inversely so that the cleaning sheet 21 faces the floor surface, the electric vacuum cleaner can catch the filth by the cleaning sheet 21 and pick up the relatively large filth via a communicating path 34 formed in between the movable member 7 and the covering member 8, and the suction opening 20 connected to the communicating path 34.

7 Claims, 7 Drawing Sheets

ELECTRIC VACUUM CLEANER

BACKGROUND OF THE INVENTION

1. Field of the Invention

The present invention relates to an electric vacuum cleaner, specifically to an electric vacuum cleaner which can wipe up a floor surface or the like while vacuuming up filth thereon.

2. Description of the Related Art

Conventional electric vacuum cleaners of this type are disclosed in, for example, Japanese Patent Registered Publication No. 3041713, Japanese Unexamined Patent Publication No. 8-294468 and Japanese Unexamined Patent Publication No. 2000-60773.

The electric vacuum cleaner disclosed in Japanese Patent Registered Publication No. 3041713 (hereinafter, "conventional cleaner 1") comprises a floor nozzle assembly having raised cloths on the lower surface thereof. This conventional cleaner 1 can wipe up a floor surface while vacuuming up filth on the floor surface when the floor nozzle assembly is moved on the floor surface with the raised cloths contacting it.

The electric vacuum cleaner disclosed in Japanese Unexamined Patent Publication No. 8-294468 (hereinafter, "conventional cleaner 2") comprises a nozzle assembly having a lower surface in which a plurality of the suction openings are formed, and a wiping member attached adjacent to the plurality of suction openings. The wiping member comprises a piece of, for example, non-woven cloth, cloth or paper. This conventional cleaner 2 can wipe up a floor while vacuuming up filth when the nozzle assembly is moved while activating a cleaner body with the wiping member contacting the floor.

The electric vacuum cleaner disclosed in Japanese Unexamined Patent Publication No. 2000-60773 (hereinafter, "conventional cleaner 3") is one that a wiping section is formed on one surface of a nozzle and a vacuuming section is formed on the other surface of the nozzle. The nozzle has an inversely rotatable structure. This conventional cleaner 3 can wipe a floor when the nozzle is rotated so that the wiping section may face a floor surface and contact it, and moved onto the floor. On the contrary, the conventional cleaner 3 can vacuum filth when the nozzle is rotated so that the vacuuming section may face the floor surface and contact it, and moved onto the floor surface.

However, according to the conventional cleaner 1, when the raised cloths become dirty by catching filth due to the wiping, it is necessary to wash the raised cloths. Thus the conventional cleaner 1 often needs maintenance to clean the raised cloths. Also, according to the conventional cleaners 1 and 2, however, the area of the raised cloth or the wiping member is relatively small because it must be shaped in order to avoid an interference with the suction opening. Efficiencies of catching filth by wiping are thus relatively low. In the conventional vacuum 3, the wiping section can be formed on one surface of the nozzle entirely thus the area of the wiping section is relatively large and an efficiency of catching filth by wiping is relatively high. However, in this structure, the wiping section is exposed to the exterior when the nozzle is inversely rotated. Therefore, it is not good in appearance when the wiping section is dirty with adhered filth. Besides, even though the nozzle employs a complex structure such that plural suction paths are formed therein, the conventional cleaner 3 can not vacuum filth when wiping the floor, or wipe the floor when vacuuming filth. Therefore, the conventional cleaner 3 can not perform multiple cleaning.

SUMMARY OF THE INVENTION

The present invention has been made to solve the above problems. It is accordingly an object of the present invention to provide an electric vacuum cleaner which can catch filth more efficiently.

Another object thereof is to provide an electric vacuum cleaner which has a multiple cleaning function.

A further object thereof is to provide an electric vacuum cleaner which has a nozzle assembly with excellent appearance.

In order to attain the above objects, according to a first aspect of the present invention, there is provided an electric vacuum cleaner having a cleaner main body including an electric fan unit therein, and a nozzle assembly connected to the cleaner body, the nozzle assembly comprising: a base member; a movable member rotatably attached to the base member, the movable member being rotatable inversely relative to the base member; and a covering member movably attached to the base member, the covering member covering the movable member from above; wherein an suction opening is formed on one surface of the movable member, and a plurality of holding members are formed on arbitrary portions in the other surface of the movable member, the other surface locating at opposite side to the one surface.

By employing this structure, when the movable member is covered by the covering member and the suction opening formed on one surface of the movable member faces a floor surface or the like, the cleaning sheet placed on the other surface of the movable member is hidden. In this state, the electric vacuum cleaner of the present invention can pick up filth through the suction opening while activating the electric fan unit. Also, by rotating the movable member inversely so that the cleaning sheet may head downwardly and face the floor surface, the cleaning sheet placed onto the other surface of the movable member is exposed downwardly and can catch filth.

A gap may be formed in between the movable member and the covering member so that a communicating path communicates a lower portion in one end of the movable member with the suction opening when one surface of the movable member is to be an upper surface.

By employing this structure, when the movable member is covered by the covering member and rotated inversely so that the cleaning sheet is exposed downwardly, filth can be picked up via the communicating path formed in between the movable member and the covering member, and caught by the cleaning sheet at once.

The covering member may comprise: a cover for covering the one surface or the other surface of the movable member; and a pair of arms having one end and the other end, the one end movably attached to the base member and the other end fixed to the cover, the pair of arms allowing the cover to move to the above of the one surface or the other surface of the movable member in order to allow the inverse rotation of the movable member for changing the subject to be covered.

The other surface of the movable member may have a rectangular shape, the plurality of holding members may be formed at the four corners of the other surface, and the cleaning sheet may cover the other surface of the movable member entirely while being held by the plurality of holding members.

The nozzle assembly may further comprise a second cover having essentially same shape and essentially same size as the other surface of the movable member and openably-and-closably attached to the base, and the cleaning sheet may be placed so as to cover both the one surface and the other surface of the second cover and held between the movable member and the second cover with the second cover being closed.

The nozzle assembly may further comprise a plurality of rollers for reducing a friction generated when the nozzle assembly moves onto a floor surface.

The movable member may further comprise an inward flange and a first circular groove, the base member may further comprise a second circular groove, the outer diameter of the second circular groove being same size as the inner diameter of the inward flange, and an outward flange, the outward-diameter of the outward flange being same size as the outer diameter of the first circular groove, the inward flange being fitted loosely into the second circular groove and the first circular groove being fitted loosely into the outward flange so that the movable member being rotatably attached to the base member.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

A preferred embodiment of the present invention will now be described in detail with reference to the accompanying drawings.

Figure 1:
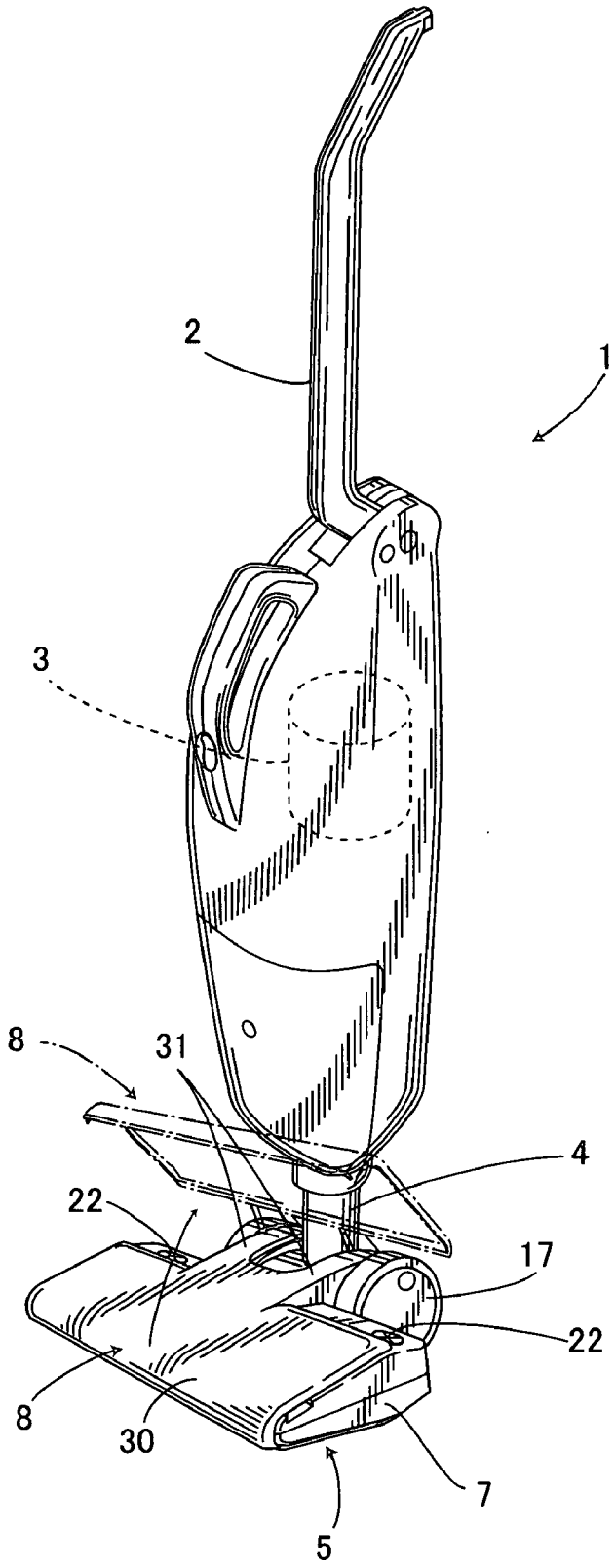
FIG. 1 is a perspective view showing the structure of an electric vacuum cleaner according to an embodiment of the present invention.

As shown in FIG. 1, an electric vacuum cleaner according to this embodiment of the present invention comprises: a cleaner main body 1 having a handle 2 foldably attached to one end thereof and an electric fan unit 3 included therein; a suction pipe 4 connected to the other end of the cleaner main body 1; and a nozzle assembly 5 connected to the cleaner main body 1 via the suction pipe 4.

Figure 2:
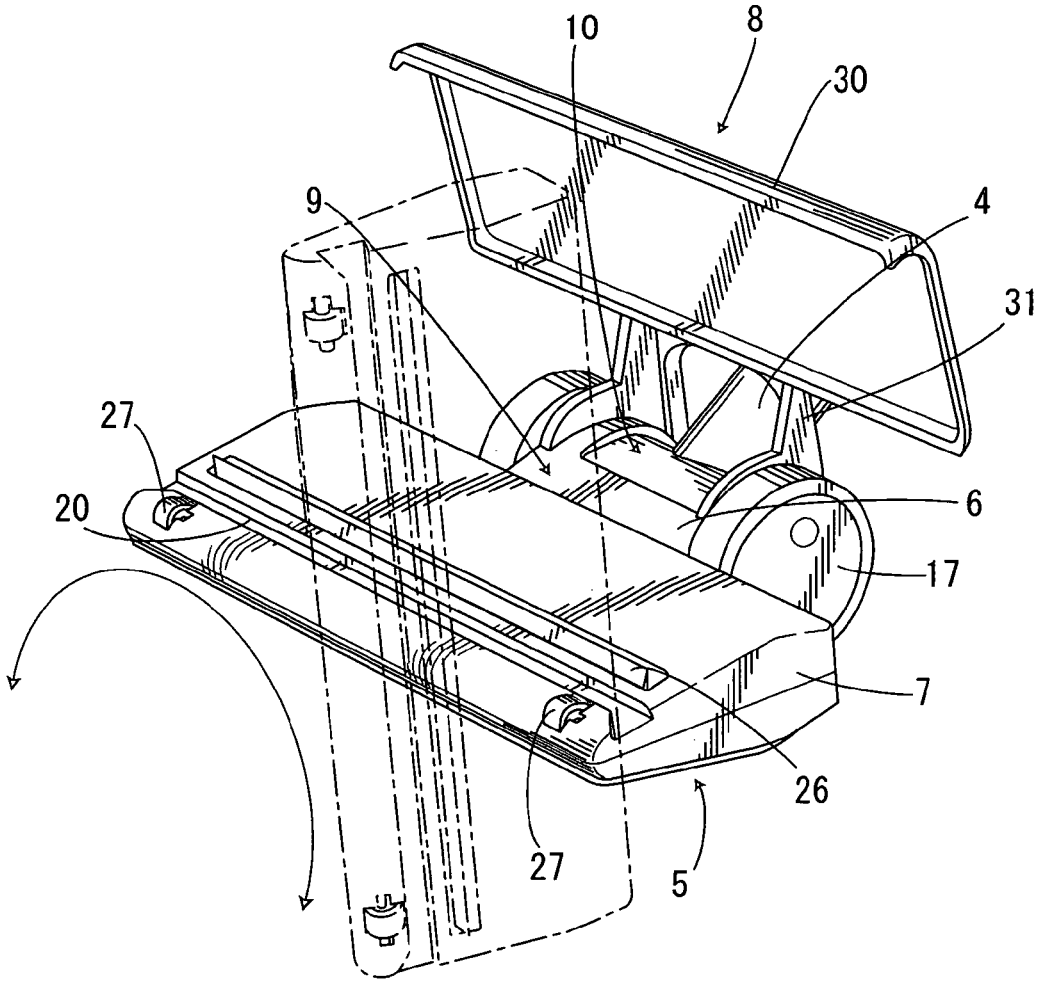
FIG. 2 is a perspective view showing the structure of a nozzle assembly included in the electric vacuum cleaner shown in FIG. 1.
Figure 3:
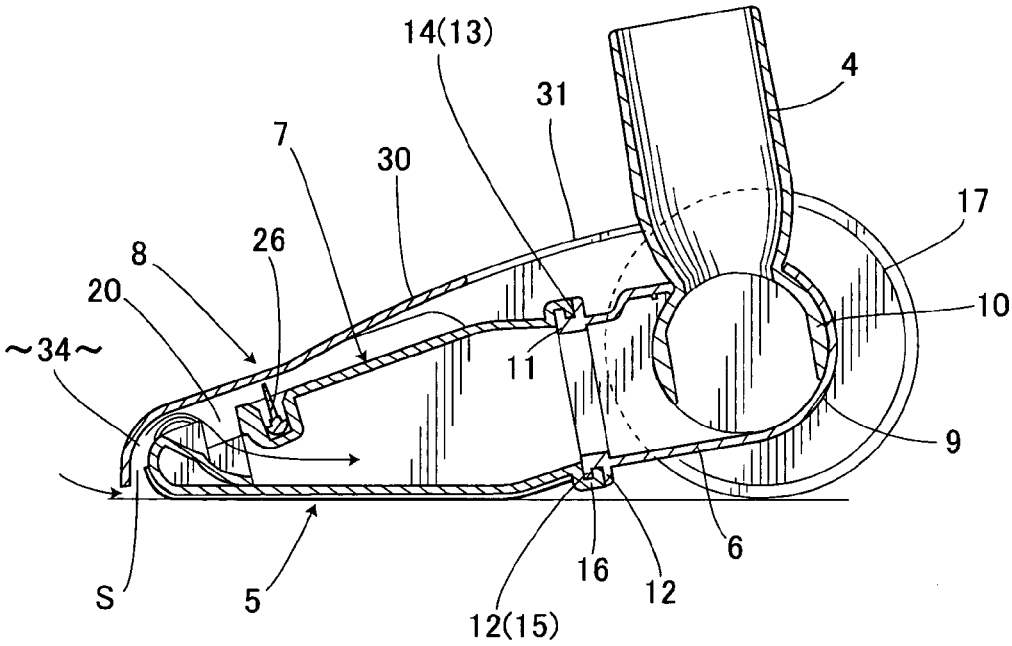
FIG. 3 is a cross sectional view showing the structure of the nozzle assembly shown in FIG. 2, in a state that a cleaning sheet faces a floor surface downwardly.
Figure 4:
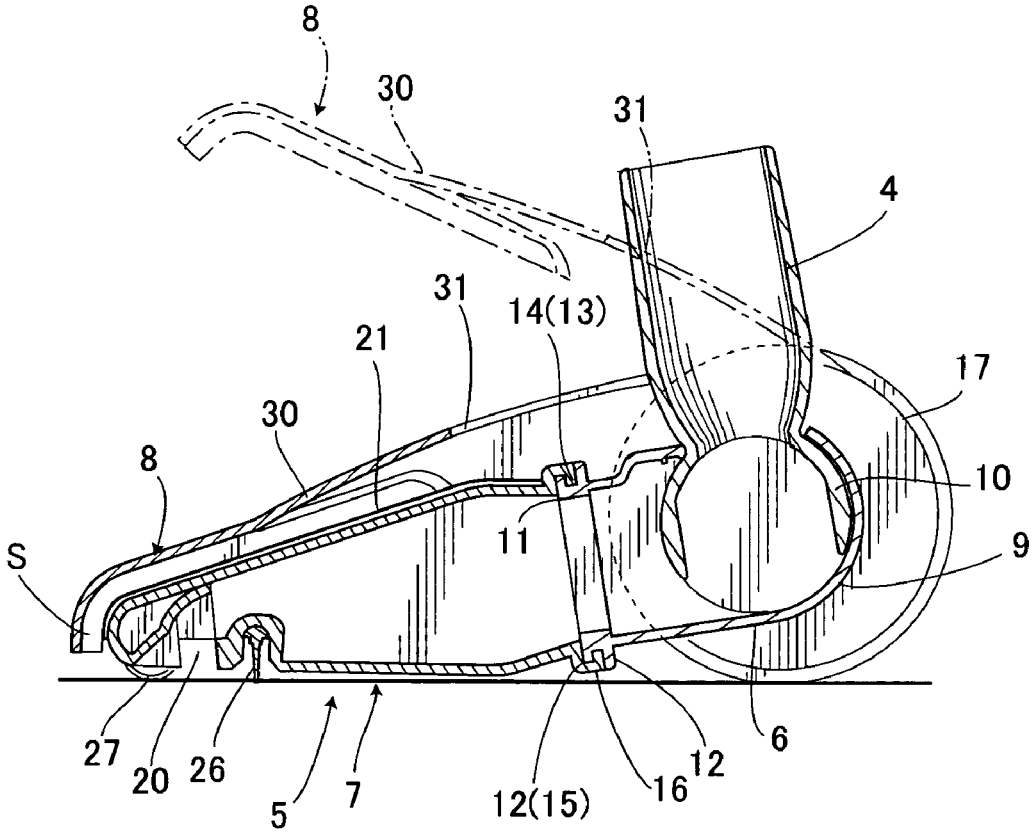
FIG. 4 is a cross sectional view showing the structure of the nozzle assembly shown in FIG. 2, in a state that a suction opening faces the floor surface downwardly.
Figure 6:
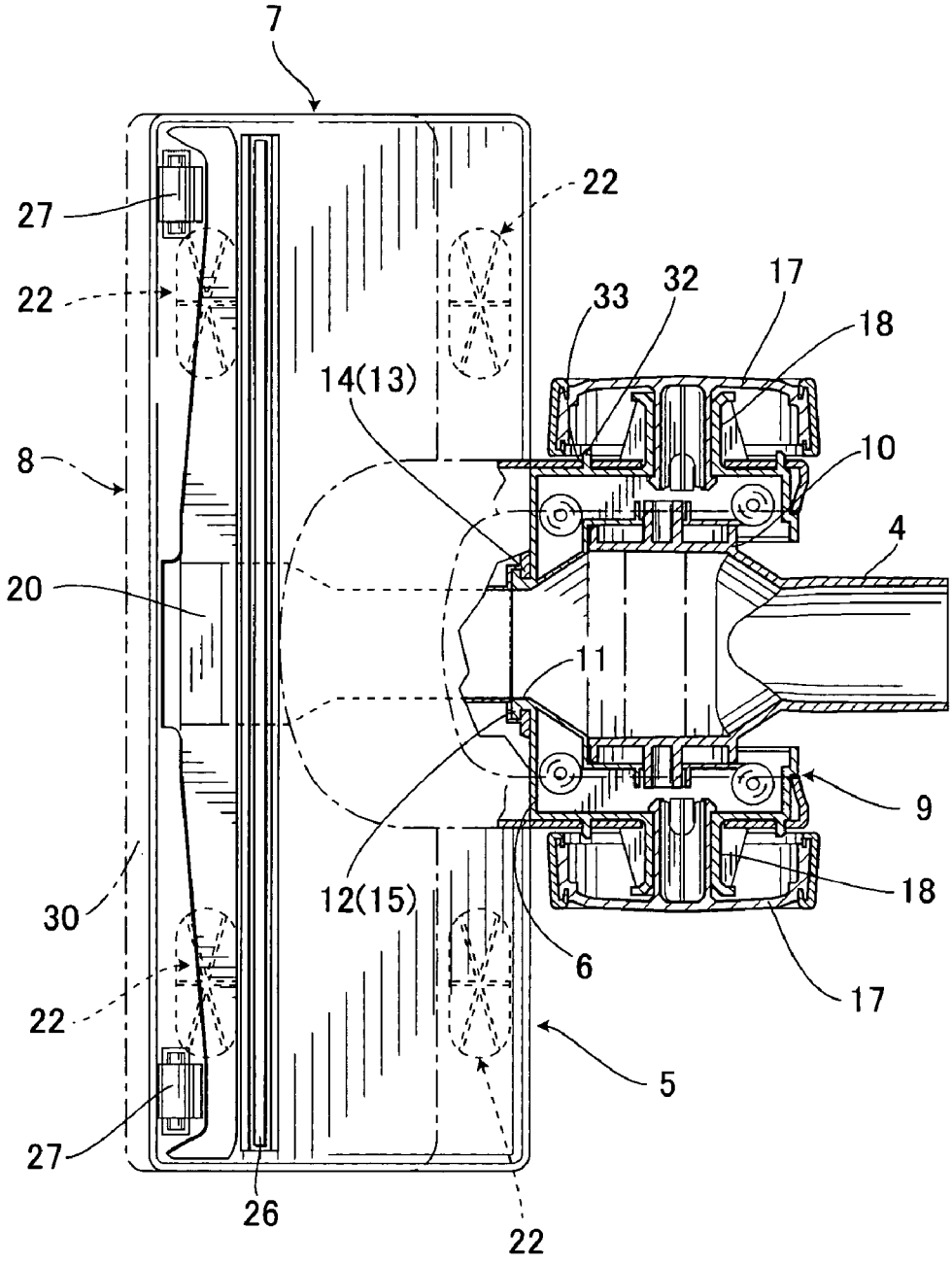
FIG. 6 is a plan view showing the structure of the nozzle assembly shown in FIG. 5.

Detail of the nozzle assembly 5 will now be described. As shown in FIGS. 2–4, the nozzle assembly 5 comprises: a base member 6; a movable member 7 rotatably attached to the base member 6 so as to be rotatable inversely relative to the base member 6; and a covering member 8 movably attached to the base member 6 and covering one surface of the movable member 7. A curved-cylindrical member 9 is attached to the rear end of the base member 6. A connecting-cylindrical member 10 extending in the horizontal direction (parallel to the longitudinal axis of the movable member 7) is contained in the hollow of the curved-cylindrical member 9. The outer surface of the connecting cylindrical member 10 has essentially the same curvature as the inner surface of the curved-cylindrical member 9, thus it can freely rotate in the hollow of the curved-cylindrical member 9. One end of the suction pipe 4 is connected to the cylindrical member 10, and the base member 6 is coupled to and freely rotates relative to the suction pipe 4. As illustrated in FIGS. 3 and 4, a short-cylindrical member 11 protruding toward a direction vertically crossing to the longitudinal direction of the cylindrical member 10 is formed on the periphery of the front end opening of the base member 6. A pair of outward flanges is formed on the outer surface of the short-cylindrical member 11, and a circular groove 13 is formed therebetween. On the periphery of the rear surface of the movable member 7, a step section 16 having an inward flange 14 and a circular groove 15 is formed. The inward flange 14 is coupled to the groove 13 and the pair of outward flanges is coupled to the groove 15 so that the movable member 7 is attached to the base member 6 and be rotatable inversely (turns over) relative to a rotational axis that vertically crosses to the longitudinal axis of the cylindrical member 10. As shown in FIG. 6, supporting axles 18 are formed on both side surfaces of the curved-cylindrical member 9, and each caster 17 is rotatably supported by one of the supporting axles 18.

Figure 5:
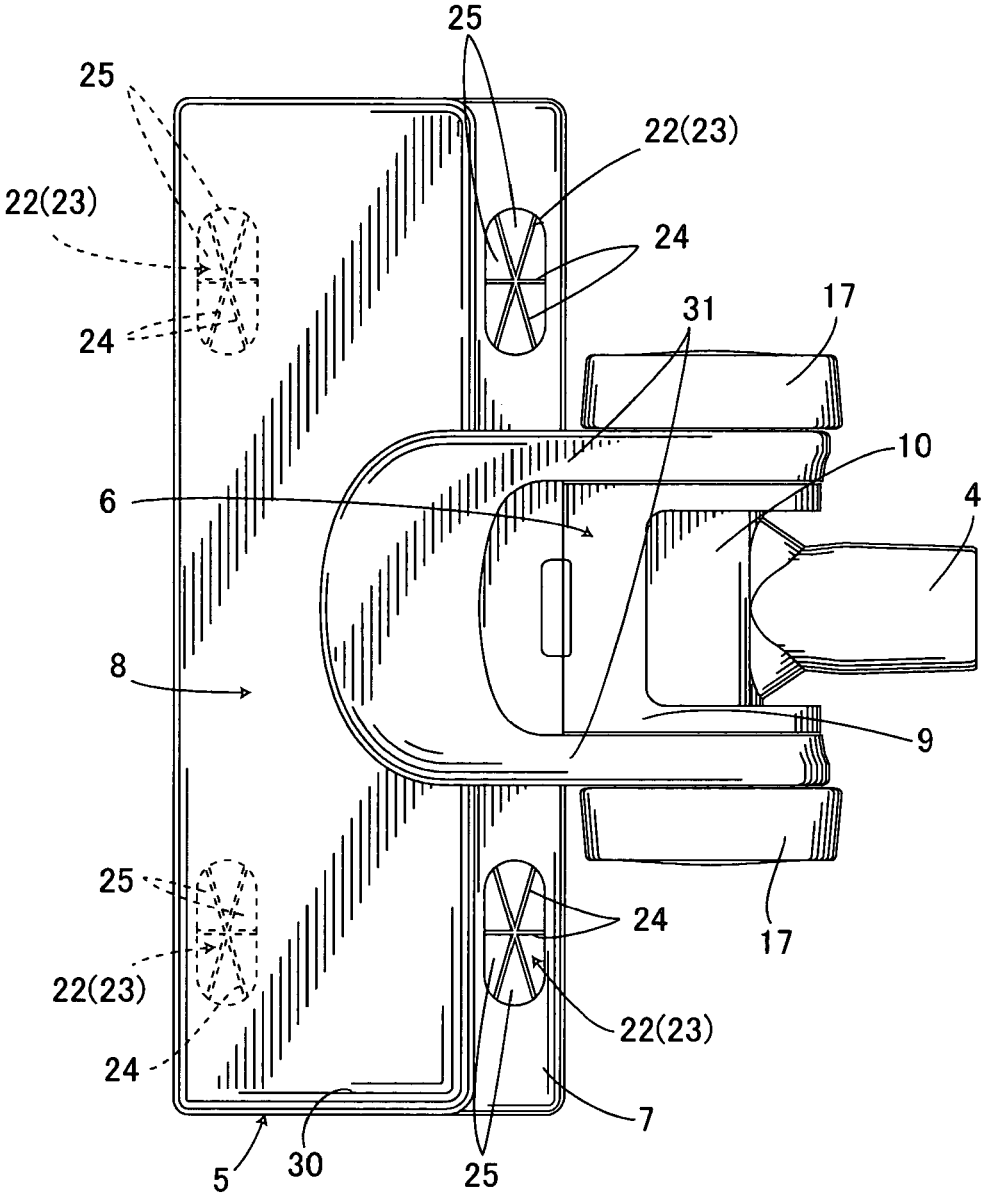
FIG. 5 is a top plan view showing the structure of the nozzle assembly shown in FIG. 2.

As shown in FIG. 2, a suction opening 20 is formed on a portion in the one surface of the movable member 7 adjacent to one end thereof, and as shown in FIGS. 1, 5 and 6, a plurality of the holding members 22 are formed on the other surface of the movable member 7 for detachably hold a cleaning sheet 21. The plurality of the holding members 22 comprise a plurality of the thinner sections 23 formed on the four corners of the movable member 7, a plurality of the slits 24 formed on the plurality of the thinner sections 23 respectively, and a plurality of the elastic hooks 25 formed by the plurality of the respective slits 24. On a portion of the movable member 7 adjacent to the one end thereof, a flexible blade 26 is placed along the suction opening 20, and on the front portion of the movable member 7 ahead of the both sides of the suction opening 20, a pair of the rollers 27 is rotatably attached.

As shown in FIGS. 1–6, the covering member 8 includes a cover 30 for covering the movable member 7 from above, and a pair of the arms 31 rotatably attached to the base member 6. Ribs 32 are formed on the curved-cylindrical member 9 for supporting the pair of arms 31. Each rib 32 is inserted into an opening for engagement 33 of the respective arm 31 so that the covering member 8 freely moves relative to the base member 6 in vertical direction. The cover 30 has a shape such that the front end thereof projects from the front end of the movable member 7 when covering it. By means of this, as shown in FIG. 3, when the movable member 7 is rotated such that one surface thereof is to be the upper surface and the upper surface is covered with the cover 30, a gap S is formed in between the movable member 7 and the cover 30. The gap S works as a communicating path 34 that communicates a bottom portion of the movable member 7 adjacent to the one end thereof and the suction opening 20.

By employing the above-described structure, the electric vacuum cleaner according to this embodiment can hold the cleaning sheet 21 using the plurality of elastic hooks 25 while pressing the four corners of the cleaning sheet 21 into the plurality of the holding members 22 formed on the movable member 7. By inversely rotating the movable member 7, the electric vacuum cleaner can wipe a floor surface using the cleaning sheet 21, while vacuuming filth (dirt, dust, etc.,) via the suction opening 20.

More specifically, when wiping the floor surface, the movable member 7 is inversely rotated relative to the base member 6 so that the cleaning sheet 21 may be held downwardly and face the floor surface as shown in FIG. 3. In this state, the nozzle assembly 5 is moved on the floor surface and the cleaning sheet 21 can catch filth. On the contrary, when vacuuming filth, the movable member 7 is inversely rotated relative to the base member 6 as shown in FIG. 4 so that the suction opening 20 formed on one surface of the movable member 7 may face the floor surface. The electric fan 3 is operated, the nozzle assembly 5 is moved on the floor surface and filth are picked up into the cleaner main body 1 via the suction opening 20 by vacuuming. When the cleaning sheet 21 is kept to be held by the movable member 7, the cleaning sheet 21 is inevitably placed onto the upper side of the nozzle assembly 5, but the covering member 8 included in the nozzle assembly 5 covers the cleaning sheet 21. Therefore, the dirty cleaning sheet 21 to which filth are adhered, is not directly exposed to the exterior because it is hidden by the covering member 8, thus the nozzle assembly 5 can have an excellent appearance. Besides, by placing the cleaning sheet 21 on the opposite side (that is, the other surface) of the movable member 7, it is not necessary for the cleaning sheet 21 to have a shape in order to avoid an interference with the suction opening 20, the cleaning sheet 21 can cover the other surface of the movable member 7 entirely. Therefore, the contacting area of the cleaning sheet 21 is relatively large and the efficiency of catching filth is relatively high. Further, when the covering member 8 covers the one surface of the movable member 7 that the suction opening is formed therein, there is provided a gap S that forms the communicating path 34 for communicating the floor surface with the suction opening 20 in between the covering member 8 and the movable member 7. By means of this, the electric vacuum cleaner 1 can pick up the relatively large filth via the communicating path 34 when the electric fan unit 3 is operated for vacuuming, and the cleaning sheet 21 can wipe remaining filth at once that the suction opening 20 does not pick up. Still further, in a case where the cleaning sheet 21 comprises, for example, a disposable sheet, it is not necessary to wash the cleaning sheet 21 when the cleaning sheet 21 become dirty due to wiping, thus a care for the cleaning sheet 21 according to this embodiment may not be needed often.

Figure 7:
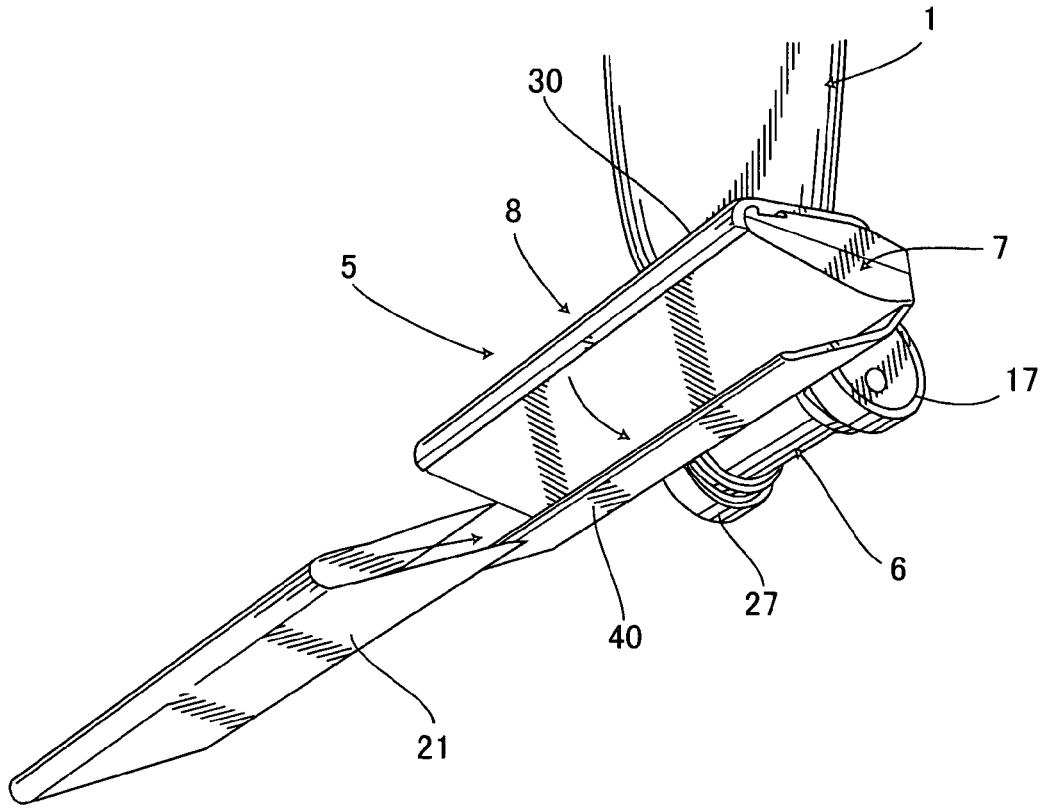
FIG. 7 is a perspective view showing the structure of the nozzle assembly according to a modification of the present invention.

The present invention is not limited to the above embodiment. For example, whilst the vertical-type vacuum cleaner is taken as an example in the above embodiment, it may be a various type of a vacuum cleaner such as a compact desktop-type cleaner, a general vacuum cleaner in which a suction opening and a cleaner main body is connected via a flexible hose, and so on. Further, regarding the structure for supporting a cleaning sheet, as shown in FIG. 7, it may be modified such that there is provided an openable and closable cover 40 on the other surface of the movable member 7, the cleaning sheet 21 is half-folded along with the cover 40 when one end thereof is latched to the base of the cover 40, and the movable member 7 holds the cleaning sheet 21 by closing the cover 40. Still further, means for holding the cleaning sheet 21 may be designed accordingly. For example, the cleaning sheet 21 may be held within a gap between the covering member 8 and the movable member 7 when the covering member 8 is closed. The shapes and the attaching structures of all components that are included in the nozzle assembly 5 are not limited to the above embodiment, but designed accordingly.

Various embodiments and changes may be made there onto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention within the claims are to be regarded to be in the scope of the present invention.

What is claimed is:

1. An electric vacuum cleaner having a cleaner main body including an electric fan unit therein, and a nozzle assembly connected to said cleaner body, said nozzle assembly comprising:

a base member;

a movable member rotatably attached to said base member, said movable member being rotatable inversely relative to said base member; and a covering member movably attached to said base member, said covering member covering said movable member from above;

wherein a suction opening is formed on one surface of said movable member, and a plurality of holding members are formed on arbitrary portions in the other surface of said movable member, said other surface located at an opposite side to the one surface.

2. The electric vacuum cleaner according to claim 1, wherein a gap is formed in between said movable member and said covering member so that a communicating path communicates a lower portion in one end of said movable member with said suction opening when one surface of said movable member faces upwards.

3. The electric vacuum cleaner according to claim 2, wherein said covering member comprises:

a cover for covering the one surface or the other surface of said movable member; and a pair of arms having one end and the other end, the one end movably attached to said base member and the other end fixed to said cover, said pair of arms allowing said cover to move to above the one surface or the other surface of said movable member in order to allow the inverse rotation of said movable member for changing a subject to be covered.

4. The electric vacuum cleaner according to claim 1, wherein:

the other surface of said movable member has a rectangular shape, while said plurality of holding members are formed at four corners of the other surface; and wherein a cleaning sheet covers the other surface of said movable member entirely while being held by said plurality of holding members.

5. The electric vacuum cleaner according to claim 1, wherein said nozzle assembly further comprises a second cover having essentially same shape and essentially same size as the other surface of said movable member and openably-and-closably attached to said base such that said cleaning sheet is placed so as to cover both the one surface and the other surface of said second cover and held between said movable member and said second cover with said second cover being closed.

6. The electric vacuum cleaner according to claim 1, wherein said nozzle assembly further comprises a plurality of rollers for reducing a friction generated when said nozzle assembly moves onto a floor surface.

7. The electric vacuum cleaner according to claim 1, wherein said movable member further comprises an inward flange and a first circular groove, while said base member further comprises a second circular groove whose outside diameter is the same as an inside diameter of said inward flange, and an outward flange whose outside diameter is the same as an outside diameter of the first circular groove, said inward flange being fitted loosely into said second circular groove while said first circular groove being fitted loosely into said outward flange so that said movable member is attached to said base member in an inversely rotatable manner.

* * * * *